US010167115B1

(12) United States Patent
Hall

(10) Patent No.: US 10,167,115 B1
(45) Date of Patent: Jan. 1, 2019

(54) SEALABLE CONTAINER ASSEMBLY WITH INTERNAL, REMOVABLE PANEL AND SPOUT

(71) Applicant: Buddeez, Inc., Wentzville, MO (US)

(72) Inventor: Charles Hall, Wentzville, MO (US)

(73) Assignee: Buddeez, Inc., Wentzville, MO (US)

( * ) Notice: Subject to any disclaimer, the term of this patent is extended or adjusted under 35 U.S.C. 154(b) by 0 days.

(21) Appl. No.: 15/858,293

(22) Filed: Dec. 29, 2017

(51) Int. Cl.

| | |
|---|---|
| ***B65D 25/48*** | (2006.01) |
| ***B65D 25/02*** | (2006.01) |
| ***B65D 25/28*** | (2006.01) |
| ***B65D 43/02*** | (2006.01) |

(52) U.S. Cl.
CPC ..... *B65D 25/48* (2013.01); *B65D 25/02* (2013.01); *B65D 25/2885* (2013.01); *B65D 43/0218* (2013.01); *B65D 2543/0049* (2013.01); *B65D 2543/00194* (2013.01); *B65D 2543/00296* (2013.01); *B65D 2543/00537* (2013.01); *B65D 2543/00555* (2013.01)

(58) Field of Classification Search
CPC .... B65D 25/48; B65D 25/20; B65D 25/2885; B65D 43/0218; B65D 2543/00194; B65D 2543/00537; B65D 2543/00555; B65D 2543/00296; B65D 2543/0049
USPC ..... 222/569, 570, 566–568; 220/254.7, 220/699–702, 317, 783, 784, 711, 717
See application file for complete search history.

(56) References Cited

U.S. PATENT DOCUMENTS

| | | | | |
|---|---|---|---|---|
| 2,906,439 | A | 9/1959 | Santuci, Sr. | |
| 3,110,436 | A | 11/1963 | Wagner | |
| 3,861,565 | A | 1/1975 | Rickmeier, Jr. | |
| 4,148,418 | A | 4/1979 | Ewing et al. | |
| 4,819,829 | A | 4/1989 | Rosten et al. | |
| D330,674 | S | 11/1992 | Lyon | |
| 5,704,510 | A * | 1/1998 | Feltman, III | A47G 19/2211 220/293 |
| D412,265 | S | 7/1999 | Hall, Jr. | |
| 6,146,673 | A | 11/2000 | Ferguson | |
| 6,279,788 | B1 * | 8/2001 | Lillelund | A47J 47/04 222/481 |
| 6,422,411 | B1 * | 7/2002 | Gray | B65D 21/022 220/214 |
| 6,896,156 | B2 | 5/2005 | McDonald et al. | |
| 6,983,862 | B2 | 1/2006 | Nottingham et al. | |
| 6,997,354 | B2 | 2/2006 | Kasting et al. | |
| 7,014,078 | B2 | 3/2006 | Walsh et al. | |
| 7,040,509 | B2 | 5/2006 | McLelland et al. | |
| 7,134,576 | B2 | 11/2006 | Gringer et al. | |
| 7,175,051 | B2 | 2/2007 | McLelland et al. | |
| 7,207,466 | B2 | 4/2007 | Walsh et al. | |

(Continued)

OTHER PUBLICATIONS

Photographs of a Progressive International Corporation container and packaging of the container having a 2016 copyright date.

*Primary Examiner* — Lien Ngo

(74) *Attorney, Agent, or Firm* — Joseph M. Rolnicki; Evans & Dixon, L.L.C.

(57) ABSTRACT

A sealable container assembly with an internal, removable panel and a spout. The container assembly has a simplified construction that includes a container, a panel with a spout that is removably positionable inside an interior volume of the container and a lid that is removably attachable to the container to seal the interior volume of the container with the panel and spout positioned in the interior volume of the container.

20 Claims, 7 Drawing Sheets

(56) References Cited

U.S. PATENT DOCUMENTS

| | | | |
|---|---|---|---|
| 7,216,779 | B2 | 5/2007 | Kasting et al. |
| 7,347,343 | B2 | 3/2008 | McLelland et al. |
| 7,353,973 | B2 | 4/2008 | Rohr |
| 7,520,410 | B2 | 4/2009 | Gilbertson et al. |
| 7,677,423 | B2 | 3/2010 | Kasting et al. |
| 7,703,631 | B2 | 4/2010 | Chafe et al. |
| 7,841,489 | B2 | 11/2010 | Gilbertson et al. |
| 7,870,979 | B2 | 1/2011 | Maki et al. |
| 8,087,554 | B2 | 1/2012 | Gringer et al. |
| 8,091,746 | B2 | 1/2012 | Gotler |
| 8,123,066 | B2 | 2/2012 | Chafe et al. |
| 8,132,690 | B2 | 3/2012 | Hall et al. |
| D741,665 | S | 10/2015 | Bagley et al. |
| 2004/0026450 | A1 | 2/2004 | Rohr et al. |
| 2005/0017012 | A1 | 1/2005 | Hodge |
| 2005/0077325 | A1 | 4/2005 | McDonald et al. |
| 2006/0118607 | A1 | 6/2006 | Meert |
| 2009/0120969 | A1 | 5/2009 | Hughes et al. |
| 2014/0311955 | A1 | 10/2014 | Jadick |
| 2017/0233160 | A1 | 8/2017 | Hudson et al. |

* cited by examiner

SEALABLE CONTAINER ASSEMBLY WITH INTERNAL, REMOVABLE PANEL AND SPOUT

FIELD OF THE INVENTION

This disclosure pertains to a sealable container assembly with an internal, removable panel and spout. The container assembly has a simplified construction that includes a container, a panel with the spout that is removably positionable inside an interior volume of the container and a lid that is removably attachable to the container to seal the interior volume of the container with the panel positioned in the interior volume of the container.

BACKGROUND

There are many different types of container assemblies that are used by consumers to store food products such as breakfast cereal, snack foods, pet foods and other equivalent types of food products. A typical container assembly of this type is comprised of a container and a lid that is removable attachable to the container. In use, a food product is removed from its original packaging and poured into the container. The lid is then removably attached to the container to seal the container and keep the food product in the container fresh.

However, when the consumer desires to store a large amount of a food product such as pet food, it is often difficult to find a container assembly that is sufficiently large to store the large amount of food product. Furthermore, larger container assemblies often have an upright configuration with a height dimension of the container being substantially larger than the base dimensions of the container. This configuration of a container assembly, when filled with food product is often unstable on a shelf or other support surface.

Still further, when dispensing or pouring food product from a top opening of the container over an edge of the container that surrounds the top opening, it is at times difficult to direct where the food product is being poured.

SUMMARY

The container assembly of this disclosure is configured to store food products such as breakfast cereal, snack food, pet food and other equivalent types of food products in an sealed interior volume of the container assembly that keeps the food product fresh. The container assembly has a relatively large size that enables storing a large amount of the food product inside the container assembly. The large size of the container assembly has a cubic, three dimensional configuration that, with the container assembly filled with a food product, is stable when positioned on a shelf or other similar support surface.

The container assembly basically consists of a container, a lid that is removably attachable to the container over a top opening of the container, and a panel with a spout. The panel with the spout is supported by the container in the interior volume of the container with the panel just below the top opening of the container. This enables the lid to be removably attached to the container with the panel in the interior volume of the container.

The panel is supported on ledge surfaces that project from interior surfaces of walls of the container toward the interior volume of the container. The ledge surfaces support the panel for sliding movement of the panel across the ledge surfaces between a first position of the panel in the interior volume of the container and a second position of the panel in the interior volume of the container. In the first position of the panel in the interior volume of the container, portions of the panel are positioned between the ledge surfaces and flanges that project inwardly from the interior surfaces of the walls of the container toward the interior volume of the container. The flanges project over the panel and prevent the panel from moving vertically or upwardly relative to the container, or out of the interior volume of the container. Thus, the flanges and the ledge surfaces on opposite sides of the panel secure the panel to the container against vertical or upward movement of the panel relative to the container, or out of the interior volume of the container. Sliding the panel over the ledge surfaces to the second position of the panel in the interior volume of the container positions the panel where the flanges do not extend over the panel. Thus, in the second position of the panel in the interior volume of the container, the panel is not secured to the container and the panel is free to move vertically or upwardly relative to the container, or out of the interior volume of the container.

With the panel removed from the interior volume of the container, the interior volume of the container is accessible through the top opening of the container. This enables the interior volume of the container to be easily filled or refilled with food product to just below the ledge surfaces.

With the container interior volume filled with food product, the panel can then be repositioned on the ledge surfaces in the interior volume of the container in the second position of the panel relative to the container. The panel can then be slid from the second position to the first position of the panel in the interior volume of the container. In the first position the flanges are again positioned over the panel and secure the panel to the container against movement of the panel relative to the container out of the interior volume of the container.

The spout on the panel is positioned toward a forward edge of the panel. In the first position of the panel in the interior volume of the container the spout is positioned adjacent a forward wall of the container. A handle extends outwardly from a rearward wall of the container. With the panel in the first position in the interior of a container, the handle and the spout are positioned at opposite ends of the container. Manually gripping the handle and elevating the container and the panel in the container, and then manually tilting the container and the panel in the container forwardly enables the dispensing or pouring of the food product in the interior volume of the container through the spout and out of the container. The spout facilitates the directing of the food product dispensed or poured from the container. With the panel secured to the container, the panel does not fall out of the interior volume of the container while pouring the food product.

When a desired amount of food product has been dispensed from the interior volume of the container, the lid of the container assembly can then be removably attached to the container over the top opening of the container and over the panel and spout in the interior volume of the container. The lid removably attached to the container seals the food product in the interior volume of a container and keeps the food product fresh.

BRIEF DESCRIPTION OF THE DRAWING FIGURES

Further features of the container assembly of this disclosure are set forth in the following detailed description of the container assembly and the drawing figures.

DETAILED DESCRIPTION OF THE INVENTION

Figure 1:
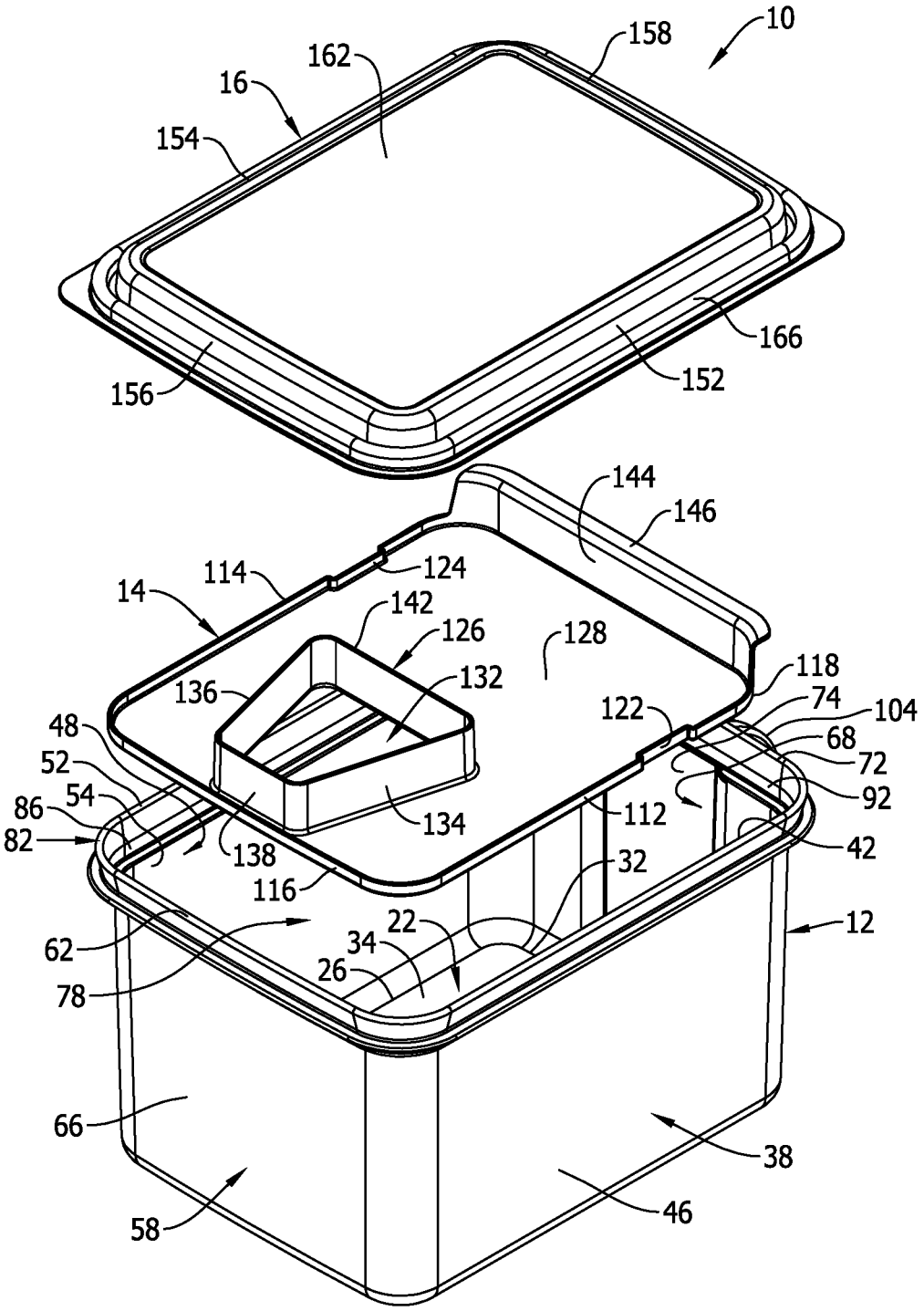
FIG. 1 is a representation of a front perspective, exploded view of the container assembly that consists of a container, a panel with a spout and a lid.
Figure 2:
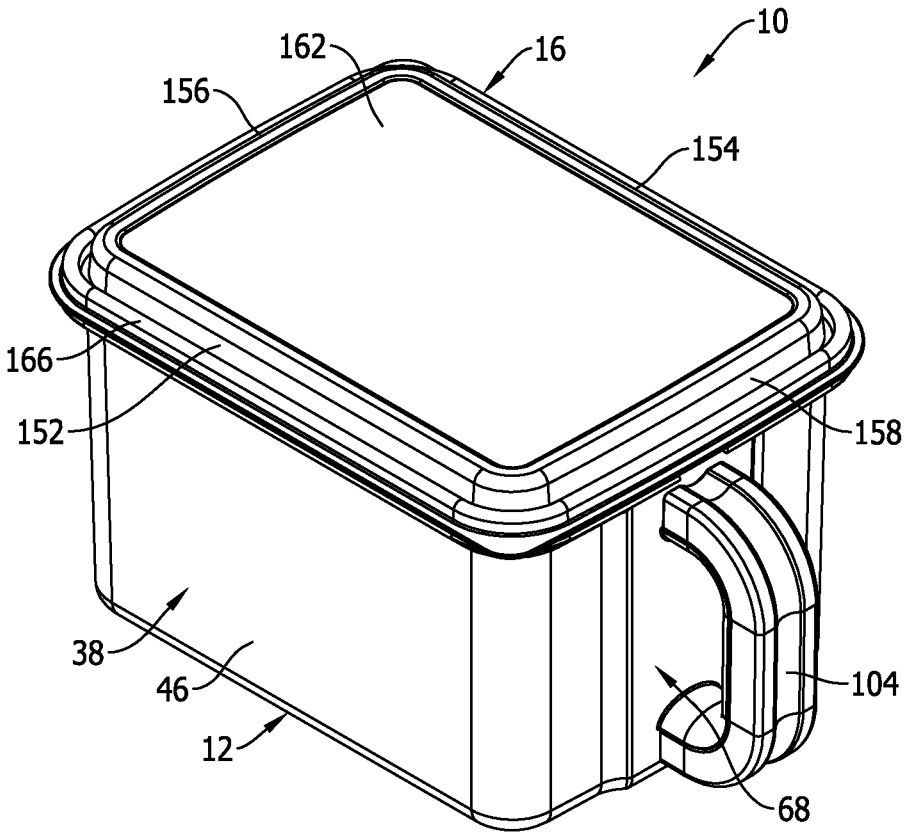
FIG. 2 is a representation of a rear perspective view of the container assembly with the panel inside the interior volume of the container and the lid removably attached to the container.

The container assembly of this disclosure has a simplified construction of three component parts that consist of a container 12, a panel with a spout 14 and a lid 16. As represented in the drawing figures, the container assembly 10 has a general cubic, three dimensional configuration. The container 12, the panel with the spout 14 and the lid 16 are constructed of a plastic material, or any other equivalent material that would provide the container 12, the panel 14 and the lid 16 with sufficient structural strength for their intended functioning.

As represented in the drawing figures, the container 12 has a base 22 at the bottom of a container. The base 22 has a general rectangular configuration defined by a first side edge 24 and an opposite second side edge 26, and a forward edge 28 and an opposite rearward edge 32. The base 22 has an interior surface 34 having a rectangular configuration defined by the edges of the base. The base 22 has an exterior surface 36 opposite the interior surface 34. The interior surface 34 and exterior surface 36 are substantially flat surfaces. With the exterior surface 36 supported on a generally horizontal separate surface, the interior surface 34 is oriented substantially horizontally.

A first side wall 38 extends vertically upwardly from the first side edge 24 of the base 22 to a first top edge portion 42 of the container 12. The first side wall 38 has an interior surface 44 and an opposite exterior surface 46.

The container 12 includes a second side wall 48 opposite the first side wall 38. The second side wall 48 extends vertically upwardly from the second side edge 26 of the base 22 to a second top edge portion 52 of the container. The second side wall 48 has an interior surface 54 and an opposite exterior surface 56.

The container 12 also includes a forward wall 58. The forward wall 58 extends vertically upwardly from the forward edge 28 of the base 22 to a forward top edge portion 62 of the container 12. The forward wall 58 has an interior surface 64 and an opposite exterior surface 66.

The container 12 also includes a rearward wall 68 opposite the forward wall 58. The rearward wall 68 extends vertically upwardly from the rearward edge 32 of the base 22 to a rearward wall top edge portion 72. The rearward wall 68 has an interior surface 74 and an opposite exterior surface 76.

The first side wall 38, the second side wall 48, the forward wall 58 and the rearward wall 68 merge together through rounded corners of the container 12. The base interior surface 34, the first side wall interior surface 44, the second side wall interior surface 54, the forward wall interior surface 64 and the rearward wall interior surface 74 all surround and enclose an interior volume 78 of the container 12. The first side wall top edge portion 42, the second side wall top edge portion 52, the forward wall top edge portion 62 and the rearward wall top edge portion 72 all merge together through the rounded corners of the container 12 and define a top edge of the container. The top edge of the container surrounds a top opening 82 of the container 12 that provides access to the interior volume 78 of the container 12.

A first ledge surface 84 is formed on the interior surface 44 of the first side wall 38. The first ledge surface 84 is positioned in close proximity to the top edge portion 42 of the first side wall 38. The first ledge surface extends horizontally across the entire interior surface 44 of the first side wall 38.

A second ledge surface 86 is formed on the interior surface 54 of the second side wall 48. The second ledge surface 86 is positioned in close proximity to the top edge portion 52 of the second side wall 48. The second ledge surface 86 extends horizontally across the entire interior surface 54 of the second side wall 48.

A forward ledge surface 88 is formed on the interior surface 64 of the forward wall 58. The forward ledge surface 88 is positioned in close proximity to the forward wall top edge portion 62. The forward ledge surface 88 extends horizontally across the entire interior surface 64 of the forward wall 58.

Rearward ledge surfaces 92, 94 are formed on the interior surface 74 of the rearward wall 68. The rearward ledge surfaces 92, 94 are positioned in close proximity to the rearward wall top edge portion 72. The rearward ledge surfaces 92, 94 are spaced from each other and extend horizontally across portions of the interior surface 74 of the rearward wall 68.

The first ledge surface 84, the second ledge surface 86, the forward ledge surface 88 and the rearward ledge surfaces 92, 94 are positioned in substantially the same horizontal plane and are substantially parallel with the interior surface 34 of the base 22 and the container top opening 82.

A first flange 96 is formed on the interior surface 44 of the first side wall 38. The first flange 96 is spaced a short distance vertically above the first ledge surface 84. The first flange 96 extends horizontally a short distance along the first ledge surface 84. The first flange 96 is positioned proximate to the rearward wall 68 of the container 12 and spaced from the forward wall 58 of the container 12.

A second flange 98 is formed on the interior surface 54 of the second side wall 48. The second flange 98 is spaced a short distance vertically above the second ledge surface 86. The second flange 98 extends horizontally a short distance along the second ledge surface 86. The second flange 98 is positioned proximate to the rearward wall 68 of the container 12 and spaced from the forward wall 58 of the container 12.

A forward flange 102 is formed on the interior surface 64 of the forward wall 58. The forward flange 102 is spaced a short distance vertically above the forward ledge surface 88. The forward flange 102 extends horizontally a short distance along the forward ledge surface 88.

A handle 104 is formed on the exterior surface 76 of the rearward wall 68 of the container 12. The handle 104 is dimensioned to comfortably receive four fingers of a hand of a user of the container 12 with the thumb of the hand wrapped around the handle 104.

As represented in the drawing figures, the panel with the spout 14 has a general rectangular configuration defined by a first panel edge 112 and an opposite second panel edge 114, and a forward edge 116 and an opposite rearward edge 118. The first panel edge 112, the second panel edge 114, the forward panel edge 116 and the rearward panel edge 118 are positioned in a single horizontal plane. A first notch 122 is formed in the first panel edge 112 and a second notch 124 is formed in the second panel edge 114. The first notch 112 is dimensioned to allow the first flange 96 to pass through the first notch, and the second notch 124 is dimensioned to allow the second flange 98 to pass through the second notch. The rectangular configuration and dimensions of the panel 14 defined by the first panel edge 112, the second panel edge 114, the forward panel edge 116 and the rearward panel edge 118 enables the panel 14 to be inserted through the top opening 82 of the container 12 and engage on top of and be supported by the first ledge surface 84, the second ledge surface 86, the forward ledge surface 88 and the rearward ledge surfaces 92, 94.

A spout 126 projects upwardly from a top surface 128 of the panel 14. The spout 126 surrounds an opening 132 through the panel. The spout 126 has a trapezoidal configuration defined by a first spout wall 134 and an opposite second spout wall 136, and a forward spout wall 138 and an opposite rearward spout wall 142. As represented in the drawing figures, the forward spout wall 138 is positioned adjacent the forward panel edge 116 and has a shorter length than the rearward spout wall 142. This defines the trapezoidal configuration of the spout 126, and assists in directing food product poured from the container assembly 10 through the spout 126. The spout 126 also extends upwardly from the panel 14 and above the top edge of the container when the panel 14 is secured to the container 12. This enables the spout 126 to pour food product from the container and over the forward wall top edge portion 62, avoiding the forward wall top edge portion 62 from interfering with the poured food product.

A finger grip 144 extends vertically, upwardly from the rearward panel edge 118. The finger grip 144 extends along the entire rearward panel edge 118. The finger grip 144 is formed with a tab 146 that projects horizontally from the top of the finger grip 144. The tab 146 extends along the entire length of the finger grip 144.

The lid 16 has a general rectangular configuration defined by a first lid side wall 152 and an opposite second lid side wall 154, and a lid forward wall 156 and an opposite lid rearward wall 158. The lid 16 has a top surface 162 and an opposite bottom surface 164 surrounded by the four side walls 152, 154, 156, 158. A channel 166 having a rectangular configuration extends completely around the outer perimeter of the first lid side wall 152, the second lid side wall 154, the lid forward wall 156 and the lid rearward wall 158. The channel 166 is configured to be removably attachable to the first top edge portion 42 of the first side wall 38, the second top edge portion 52 of the second side wall 48, the forward wall top edge portion 62 of the forward wall 58 and the rearward wall top edge portion 72 of the rearward wall 68. The configuration of the channel 166 also enables removably attaching the lid 16 to the container 12 in sealing engagement.

In assembling the container 12, the panel 14 and the lid 16, the panel 14 is first manually moved and positioned above the top opening 82 of the container 12 with the first notch 122 in the first panel edge 112 and the second notch 124 in the second panel edge 114 positioned above the respective first flange 96 and second flange 98 of the container 12. The panel 14 is moved by manually gripping the finger grip 144 and finger grip tab 146 along the rearward panel edge 118 and manually moving the panel 14. The panel 14 is then moved downwardly causing the first flange 96 to pass through the first notch 122 in the first panel edge 112 and causing the second flange 98 to pass through the second notch 124 in the second panel edge 114. The downward movement is continued until the panel 14 rests on the first ledge surface 84, the second ledge surface 86 and the rearward ledge surfaces 92, 94. With the panel 14 supported by the container 12 on the first ledge surface 84, the second ledge surface 86 and the rearward ledge surfaces 92, 94, the finger grip 144 and finger grip tab 146 are then manually pushed toward the forward wall 58 of the container. This causes the panel 14 to slide across the first ledge surface 84 and the second ledge surface 86 toward the forward wall 58 of the container 12. The forward sliding movement of the panel 14 is continued until the panel rearward edge 118 disengages from the rearward ledge surfaces 92, 94 and the forward panel edge 116 comes into sliding engagement on the forward ledge surface 88. The sliding movement of the panel 14 is stopped when the forward panel edge 116 comes into engagement with the forward wall interior surface 64. This is the first position of the panel 14 relative to the container 12. In this first position of the panel 14, the first flange 96 engages over the first panel edge 112, the second flange 98 engages over the second panel edge 114 and the forward flange 102 engages over the forward panel edge 116. This secures the panel 114 to the container 12 and prevents vertical or upward movement of the panel 14 relative to the container 12, and prevents the panel 14 from falling out of the interior volume 78 of the container 12 when pouring food product from the container 12.

Figure 3:
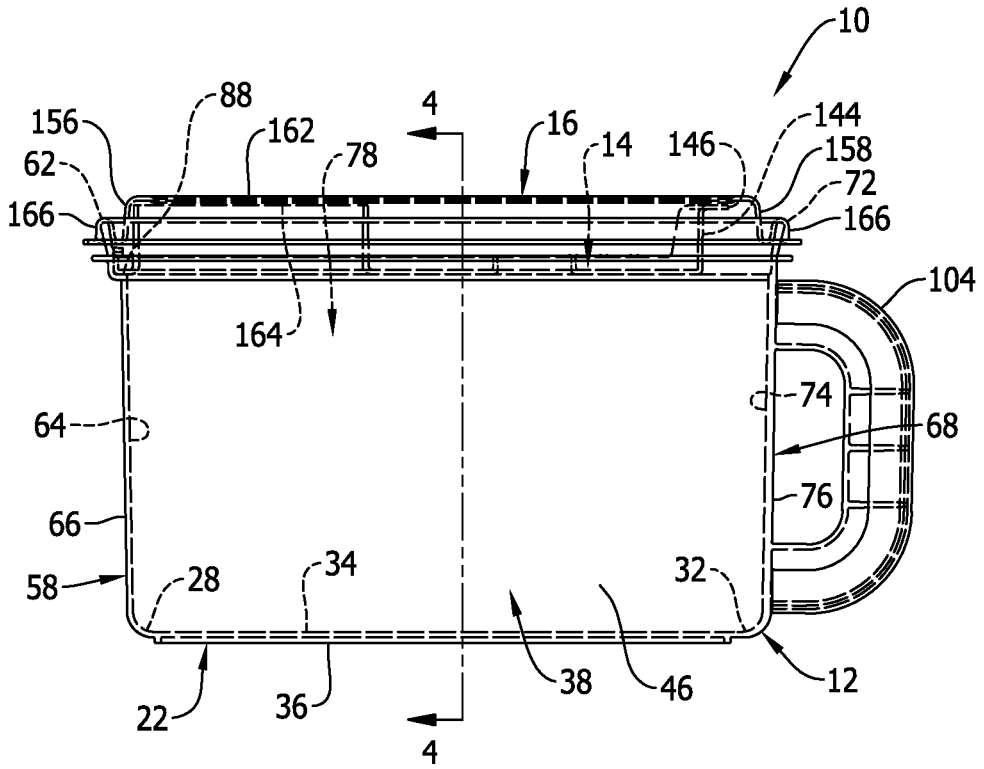
FIG. 3 is a representation of a side elevation view of the container assembly with internal features of the container assembly represented in dashed lines.
Figure 4:
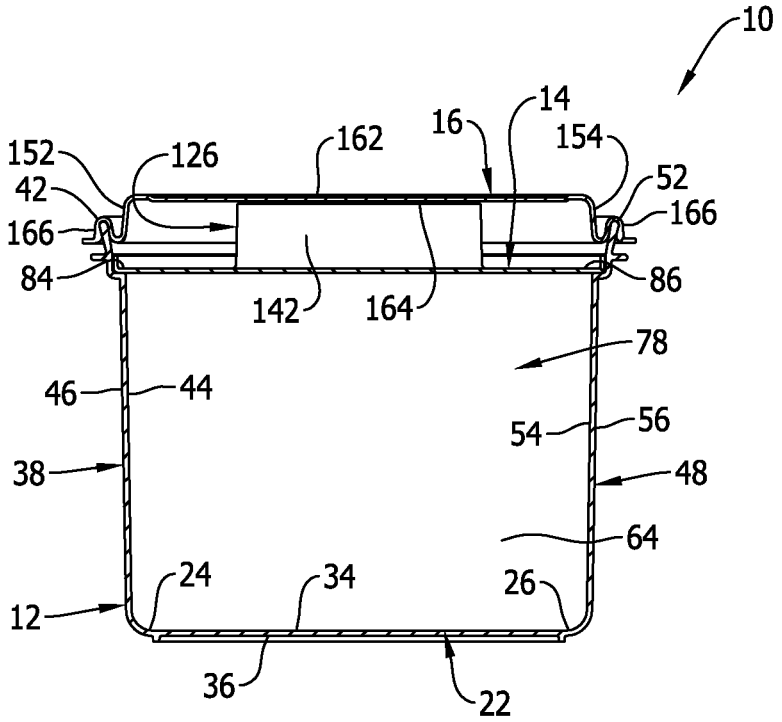
FIG. 4 is a representation of a cross-section, elevation view of the container assembly in the plane of line 4-4 of FIG. 3.
Figure 5:
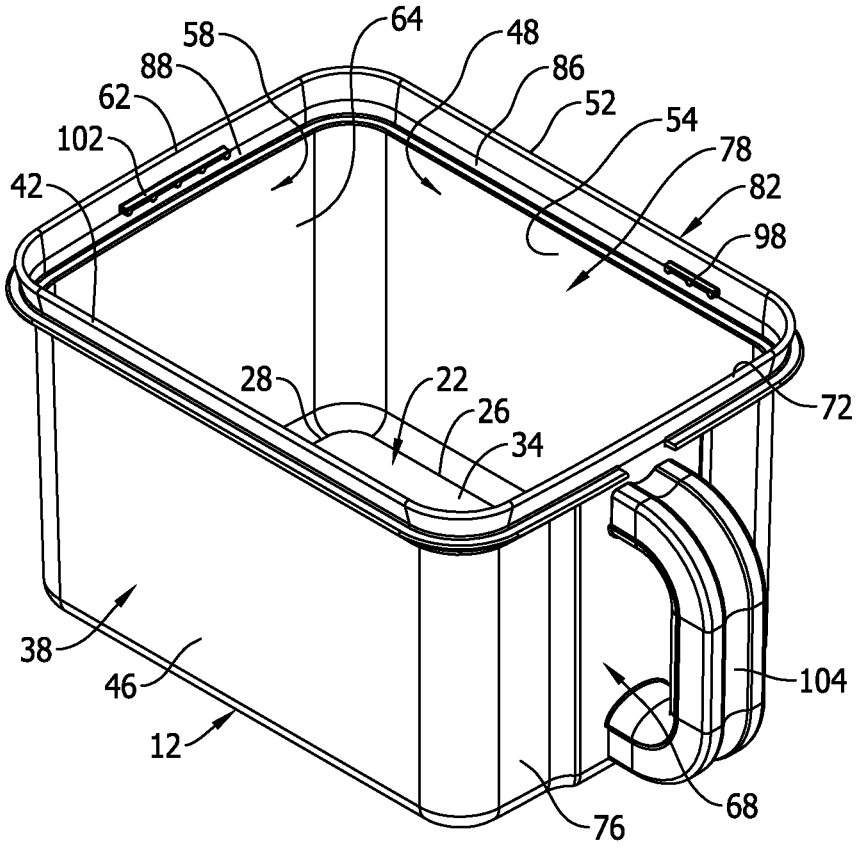
FIG. 5 is a representation of a rear perspective view of the container with the panel and lid removed.
Figure 6:
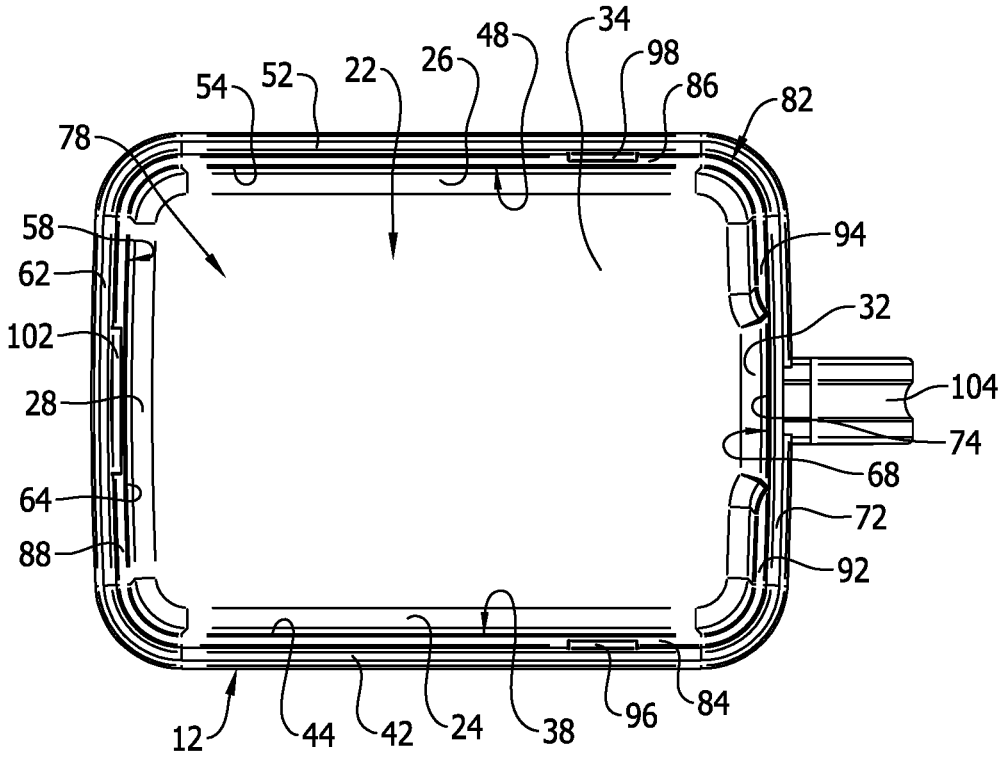
FIG. 6 is a representation of a plan view of the container.
Figure 8:
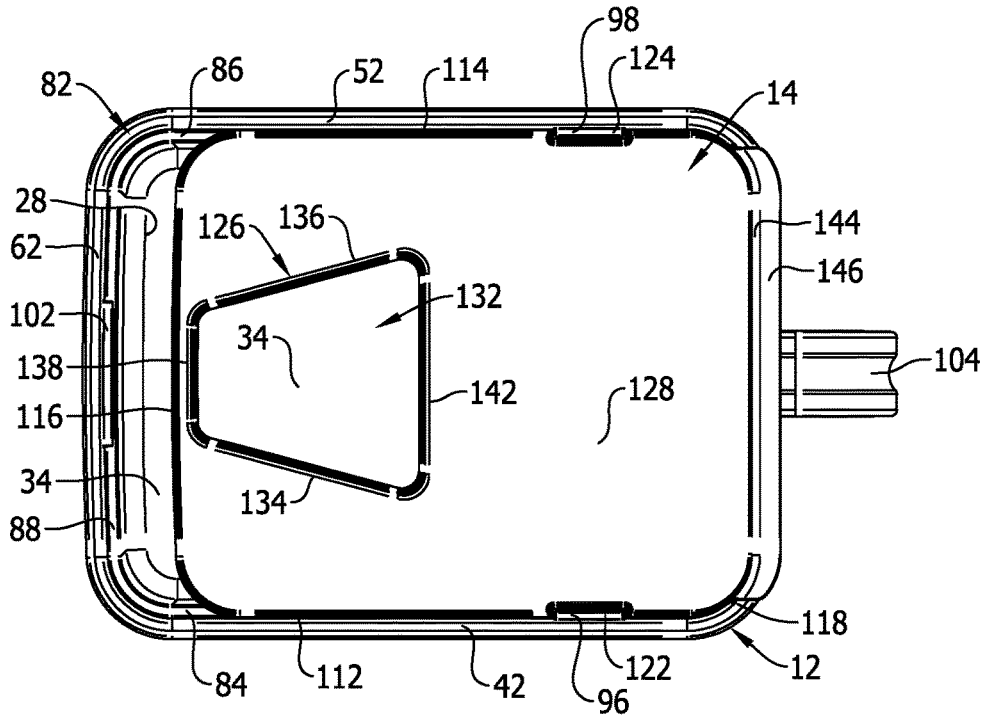
FIG. 8 is a representation of a plan view of the container and the panel with the spout in a second position of the panel and spout relative to the container.
Figure 7:
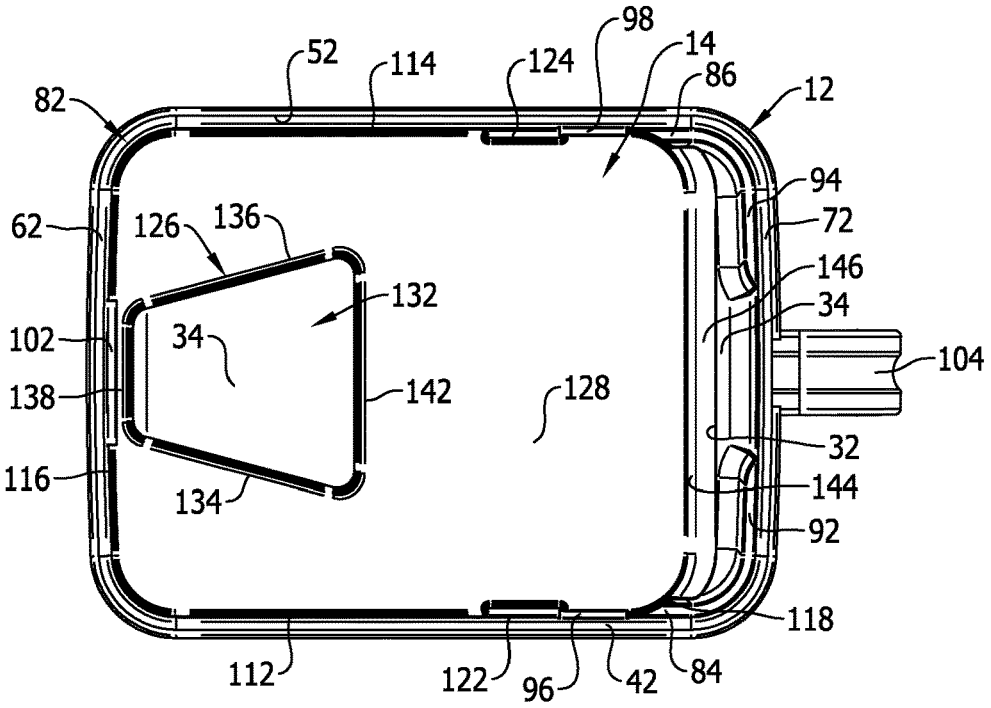
FIG. 7 is a representation of a plan view of the container and the panel with the spout in a first position of the panel and spout relative to the container.

With the panel 14 in its first position relative to the container 12, the lid 16 can be removably attached to the container 12. The lid 16 is removably attached to the container 12 by attaching the channel 166 of the lid 16 over the first top edge portion 42 of the first side wall 38, over the second top edge portion 52 of the second side wall 48, over the forward wall top edge portion 62 of the forward wall 58 and over the rearward wall top edge portion 72 of the rearward wall 68. Vertical height dimensions of the first lid side wall 152, the second lid side wall 154, the lid forward wall 156 and the lid rearward wall 158 space the bottom surface 164 of the lid 16 above the spout 126 and the finger grip 144 as represented in FIGS. 3 and 4.

To fill the container assembly 10 with a food product, the lid 16 is first removed from the container 12 exposing the panel 14 in the top opening 82 of the container 12. The finger grip 144 and finger grip tab 146 can then be manually moved toward the rearward ledge surfaces 92, 94. This causes the panel 14 to slide over the first ledge surface 84 and second ledge surface 86, and disengage from the forward ledge surface 88. The sliding movement of the panel 14 over the first ledge surface 84 and second ledge surface 86 is continued until the first notch 122 is vertically aligned with the first flange 96 and the second notch 124 is vertically aligned with the second flange 98, the forward panel edge 116 is moved from beneath the forward flange 102 and the rearward panel edge 118 is moved on top of the rearward ledge surfaces 92,94 and against the interior surface 74 of the rearward wall 68 of the container 12. This is the second position of the panel 14 relative to the container 12. In the second position of the panel 114 relative to the container 12, manually lifting the finger grip 144 and the finger grip tab 146 vertically upwardly causes the panel 14 to move vertically upwardly and causes the first flange 96 to pass through the first notch 122 and causes the second flange 98 to pass through the second notch 124. Continued manual movement of the panel 14 vertically upwardly removes the panel 114 from the interior volume 78 of the container 12. This exposes the top opening 82 of the container 12. Food product can then be added to the interior volume 78 of the container 12 through the top opening 82 of the container 12.

The container 12 is filled with food product to just below the horizontal plane of the first ledge surface 84, the second ledge surface 86, the forward ledge surface 88 and the rearward ledge surfaces 92, 94. With the interior volume 82 of the container 12 filled with the desired amount of food product, the panel 14 can then be removably attached to the container 12 in the manner previously described. The lid 16 can then be attached to the container 12 to seal closed the container assembly 10 and seal the food product in the interior volume 78.

As various modifications could be made in the construction of the container assembly and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A container assembly comprising:

a container having an interior volume and a top opening providing access into the interior volume;

a panel with a spout, the panel being supported by the container in the interior volume of the container for movement of the panel horizontally between a first position of the panel in the interior volume where the panel is secured to the container against vertical movement of the panel relative to the container and a second position of the panel in the interior volume where the panel is unsecured from the container for vertical movement of the panel relative to the container out of the interior volume of the container; and, a lid removably attachable to the container over the top opening of the container with the panel supported by the container in the interior volume of the container.

2. The container assembly of claim 1, further comprising:

the container having a forward wall and a rearward wall on opposite sides of the interior volume of the container;

the panel engaging against the forward wall of the container when the panel is in the first position of the panel in the interior volume of the container; and, the panel engaging against the rearward wall of the container when the panel is in the second position of the panel in the interior volume of the container.

3. The container assembly of claim 1, further comprising:

a ledge surface on the container in the interior volume of the container, the ledge surface being oriented horizontally; and, the panel engaging in sliding contact on the ledge surface, the panel being supported by the ledge surface in the interior volume of the container.

4. The container assembly of claim 3, further comprising:

the container having a first side wall and a second side wall on opposite sides of the interior volume of the container; and, the ledge surface being one of a first ledge surface and a second ledge surface on the respective first side wall and second side wall, the first ledge surface and the second ledge surface projecting into the interior volume of the container.

5. The container assembly of claim 4, further comprising:

the panel engaging in sliding contact with the first ledge surface and the second ledge surface and being supported by the first ledge surface and the second ledge surface in the interior volume of the container.

6. The container assembly of claim 5, further comprising:

the container having a first flange and a second flange on the respective first side wall and second side wall on opposite sides of the interior volume of the container, the first flange and the second flange project over the respective first ledge surface and second ledge surface on opposite sides of the interior volume of the container; and, the first flange and the second flange project over the panel in the first position of the panel in the interior volume of the container where the first flange and the second flange secure the panel to the container against movement of the panel relative to the container and the first flange and the second flange do not project over the panel in the second position of the panel in the interior volume of the container.

7. The container assembly of claim 6, further comprising:

the panel having a first panel edge and a second panel edge at opposite sides of the panel;

a first notch in the first panel edge;

a second notch in the second panel edge; and, the first flange being vertically aligned with the first notch and the second flange being vertically aligned with the second notch when the panel is in the second position of the panel in the interior volume of the container.

8. The container assembly of claim 7, further comprising:

the first notch being configured to allow the first flange to pass through the first notch; and, the second notch being configured to allow the second flange to pass through the second notch.

9. The container assembly of claim 1, further comprising:

the panel having a top surface that is substantially flat, the spout extends from the top surface, and the top surface is oriented horizontally in the interior volume of the container with the panel being supported by the container in the interior volume of the container.

10. The container assembly of claim 9, further comprising:

the container having a forward wall;

the forward wall having a top edge portion; and, the spout extends upwardly from the top surface of the panel above the forward wall top edge portion with the panel being supported by the container in the interior volume of the container.

11. A container assembly comprising:

a container having an interior volume and a top opening providing access into the interior volume;

the container having a wall, the wall having an interior surface that opposes the interior volume of the container;

a flange projects from the interior surface of the wall into the interior volume of the container;

a panel with a spout, the panel being supported by the container in the interior volume of the container for movement of the panel between a first position of the panel in the interior volume of the container where the flange extends over the panel and secures the panel against moving out of the interior volume of the container, and a second position of the panel in the interior volume of the container where the flange does not extend over the panel and the panel is free to move out of the interior volume of the container; and, a lid removably attachable to the container over the top opening of the container with the panel supported by the container in the interior volume of the container.

12. The container assembly of claim 11, further comprising:

the wall being one of a first wall and a second wall of the container, the first wall having an interior surface that opposes the interior volume of the container and the second wall having an interior surface that opposes the interior volume of the container;

the flange being one of a first flange and a second flange, the first flange projects from the interior surface of the first wall into the interior volume of the container and the second flange projects from the interior surface of the second wall into the interior volume of the container; and, the panel being supported by the container in the interior volume of the container for movement of the panel between the first position of the panel in the interior volume of the container where the first flange and the second flange extend over the panel and secure the panel against moving out of the interior volume of the container, and a second position of the panel in the interior volume of the container where the first flange and the second flange do not extend over the panel and the panel is free to move out of the interior volume of the container.

13. The container assembly of claim 11, further comprising:

the panel having an edge;

a notch in the edge of the panel; and, the notch being spaced from the flange when the panel is in the first position of the panel in the interior volume of the container and the notch being aligned with the flange when the panel is in the second position of the panel in the interior volume of the container.

14. The container assembly of claim 12, further comprising:

the panel having a first panel edge and a second panel edge at opposite sides of the panel;

a first notch in the first panel edge;

a second notch in the second panel edge;

the first notch being spaced from the first flange and the second notch being spaced from the second flange when the panel is in the first position of the panel in the interior volume of the container; and, the first notch being aligned with the first flange and the second notch being aligned with the second flange when the panel is in the second position of the panel in the interior volume of the container.

15. The container assembly of claim 14, further comprising:

the first notch being configured to enable the first flange to pass through the first notch and the second notch being configured to enable the second flange to pass through the second notch when the panel is moved out of the interior volume of the container.

16. The container assembly of claim 12, further comprising:

a first ledge surface on the first side wall of the container;

a second ledge surface on the second side wall of the container; and, the panel engaging in sliding contact with the first ledge surface and the second ledge surface and being supported by the first ledge surface and the second ledge surface in the interior volume of the container.

17. The container assembly of claim 16, further comprising:

the first flange projecting from the interior surface of the first wall over the first ledge surface; and, the second flange projecting from the interior surface of the second wall over the second ledge surface.

18. A container assembly consisting of:

a container;

a panel with a spout;

a lid;

the container having an interior volume and a top opening providing access into the interior volume;

the panel being supported by the container in the interior volume of the container for movement of the panel horizontally between a first position of the panel in the interior volume where the panel is secured to the container against movement of the panel out of the interior volume of the container and a second position of the panel in the interior volume of the container where the panel is unsecured from movement of the panel out of the interior volume of the container; and, the lid being removably attachable to the container over the top opening of the container with the panel supported by the container in the interior volume of the container.

19. The container assembly of claim 18, further consisting of:

the container having a first side wall and a second side wall on opposite sides of the interior volume of the container;

a first ledge surface on the first side wall and a second ledge surface on the second side wall; and, the panel engaging in sliding contact with the first ledge surface and the second ledge surface and being supported by the first ledge surface and the second ledge surface in the interior volume of the container.

20. The container assembly of claim 18, further consisting of:

a first flange on the first side wall and a second flange on the second side wall;

the first flange projecting over the first ledge surface and the second flange projecting over the second ledge surface; and, the first flange and the second flange projecting over the panel in the first position of the panel in the interior volume of the container where the first flange and the second flange secure the panel to the container against movement of the panel relative to the container and out of the interior volume of the container, and the first flange and the second flange do not project over the panel in the second position of the panel in the interior volume of the container, enabling the panel to be moved out of the interior volume of the container.

* * * * *